US010498084B2

(12) United States Patent
Miyamura et al.

(10) Patent No.: US 10,498,084 B2
(45) Date of Patent: Dec. 3, 2019

(54) ELECTRICAL CONNECTION DEVICE HAVING CONNECTION DETECTION FUNCTION

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Masaaki Tabata, Mie (JP); Yasuo Omori, Mie (JP); Hajime Matsui, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/090,284

(22) PCT Filed: Apr. 11, 2017

(86) PCT No.: PCT/JP2017/014798
§ 371 (c)(1),
(2) Date: Oct. 1, 2018

(87) PCT Pub. No.: WO2017/187962
PCT Pub. Date: Nov. 2, 2017

(65) Prior Publication Data

US 2019/0115695 A1 Apr. 18, 2019

(30) Foreign Application Priority Data

Apr. 26, 2016 (JP) ..... 2016-087622

(51) Int. Cl.
*H01R 13/64* (2006.01)
*H01R 13/641* (2006.01)

(52) U.S. Cl.
CPC ..... *H01R 13/641* (2013.01); *H01R 13/64* (2013.01)

(58) Field of Classification Search
CPC ..... H01R 13/64; H01R 13/641
See application file for complete search history.

(56) References Cited

U.S. PATENT DOCUMENTS 5,120,255 A * 6/1992 Kouda ..... H01R 13/641 439/489
5,192,225 A 3/1993 Suzuki
(Continued)

FOREIGN PATENT DOCUMENTS

JP 4-16887 2/1992
JP 4-61876 5/1992
(Continued)

OTHER PUBLICATIONS

International Search Report dated Jul. 4, 2017.

*Primary Examiner* — Briggitte R. Hammond
*Assistant Examiner* — Milagros Jeancharles
(74) *Attorney, Agent, or Firm* — Gerald E. Hespos; Michael J. Porco; Matthew T. Hespos

(57) ABSTRACT

An electrical connection device reliably detects a connected state of connectors and includes first and second connectors (C1, C2) first and second housings (10, 20) and a connection detector (30). The first housing (10) includes a detector restraining portion (14*b*). The second housing (20) includes a restraint releasing portion (26) for restraining the connection detector (30) until the first housing (10) reaches a connection position and releasing the restraint when the connection position is reached. The first housing (10) includes a connection allowance switch having a connection
(Continued)

preventing portion (19). The connection allowance switch is deformable to displace the connection preventing portion (19) from a connection preventing position to a connection allowing position. The connection detector (30) includes a connection switch (38) for deforming the connection allowance switch to displace the connection preventing portion (19) to the connection allowing position with the connection detector mounted in the first housing (10).

8 Claims, 14 Drawing Sheets

(56) References Cited

U.S. PATENT DOCUMENTS 5,203,718 A 4/1993 Chishima
5,539,915 A * 7/1996 Burton ..... G06F 3/0601 710/21
5,618,201 A * 4/1997 Yagi ..... H01R 13/6275 439/489
5,759,058 A * 6/1998 Childs ..... H01R 13/641 439/352
6,109,955 A * 8/2000 Hanazaki ..... H01R 13/641 439/352
6,129,577 A * 10/2000 Daoud ..... G01R 31/045 324/72.5
6,315,585 B1 * 11/2001 Oka ..... H01R 13/62938 439/157
6,328,614 B1 * 12/2001 Osawa ..... H01R 13/4223 439/752
6,435,895 B1 * 8/2002 Fink ..... H01R 13/6272 439/352
6,712,636 B2 * 3/2004 Fukuda ..... H01R 13/6271 439/353
7,294,015 B2 * 11/2007 Fujii ..... H01R 13/641 439/489
7,470,138 B1 * 12/2008 Chen ..... H01R 13/506 439/352
7,666,026 B2 * 2/2010 Takehara ..... H01R 13/62955 439/489
8,747,146 B2 * 6/2014 Brown ..... H01R 13/641 439/489
9,142,919 B2 * 9/2015 Osada ..... H01R 13/6272
9,350,116 B1 * 5/2016 Morello ..... H01R 13/639
9,490,574 B2 * 11/2016 Kon ..... H01R 13/627
9,490,576 B2 * 11/2016 Plazio ..... H01R 13/641
9,608,373 B2 * 3/2017 Wu ..... H01R 13/639
9,680,256 B1 * 6/2017 Lane ..... H01R 13/6275
9,831,601 B2 * 11/2017 Kim ..... H01R 13/6272
9,893,464 B2 * 2/2018 Endo ..... H01R 13/6271
9,935,396 B2 * 4/2018 Endo ..... H01R 13/6271
9,935,399 B2 * 4/2018 Sekino ..... H01R 13/641
10,234,826 B2 * 3/2019 Lee ..... G04G 9/00
2015/0270643 A1 * 9/2015 Myer ..... H01R 13/6273 439/357
2018/0226748 A1 * 8/2018 Hayasaka ..... H01R 13/6272
2019/0013622 A1 * 1/2019 Miyamura ..... H01R 43/26
2019/0044278 A1 * 2/2019 Amemiya ..... H01R 13/6272

FOREIGN PATENT DOCUMENTS

JP 4-147583 5/1992
JP 4-174983 6/1992
JP 2008-218116 9/2008
JP 2014-44825 3/2014
JP 2015-41469 3/2015

* cited by examiner

ELECTRICAL CONNECTION DEVICE HAVING CONNECTION DETECTION FUNCTION

BACKGROUND

Field of the Invention

The invention relates to an electrical connection device including a first connector and a second connector connectable to each other and having a function of detecting a connected state of the first and second connectors.

Description of the Related Art

Japanese Unexamined Patent Publication No. 2014-44825 and Japanese Unexamined Patent Publication No. 2015-41469 disclose electrical connection devices having a connection detection function. Each of these devices includes male and female connectors that are connectable to each other and a tool for detecting the connection of the connectors. The female connector is shaped to receive the male connector and includes a lock piece that is deflectable and deformable inward as the other connector is inserted. The tool is inserted into the female connector together with the male connector while being inserted between a body of the male connector and the lock piece.

In this device, the lock piece prevents the separation of the tool from the lock piece by being deflected and deformed while the connectors are being connected, whereas the lock piece allows the separation of the tool from the lock piece by resiliently returning toward an initial position when the connection of the connectors is completed properly. Thus, an operator can recognize that the connectors are in an incompletely connected state where the connection of the connectors is not completed properly if the tool cannot be separated.

There is a possibility that the connectors described in Japanese Unexamined Patent Publication No. 2014-44825 and Japanese Unexamined Patent Publication No. 2015-41469 are connected without using the tool for connection detection. In this case, the connectors are used without confirming the connected state by the tool, which is not preferable.

The invention aims to provide an electrical connection device with a first connector and a second connector connectable to each other, and in which a connected state of the first and second connectors is detected more reliably.

SUMMARY

An electrical connection device has first and second connectors. The first connector includes a first terminal and a first housing for holding the first terminal. The second connector includes a second terminal to be electrically conductive with the first terminal by being connected to the first terminal in a specific terminal connecting direction and a second housing for holding the second terminal. A connection detector is to be mounted into the first housing to detect a connected state of the first and second terminals. The first housing includes a detector restraining portion for restraining the connection detector to prevent the separation of the connection detector from the first housing. The second housing includes a restraint releasing portion for maintaining the restraint of the connection detector by the detector restraining portion until a relative position of the first housing with respect to the second housing reaches a proper connection position where the first and second terminals are connected completely and operating at least one of the detector restraining portion and the connection detector to release the restraint of the connection detector by the detector restraining portion when the relative position reaches the proper connection position. The first housing includes a housing body and a connection allowance switch connected to the housing body and having a connection preventing portion. The connection allowance switch is shaped to hold the connection preventing portion at a connection preventing position where the connection preventing portion contacts the second housing to prevent an arrival of the first housing at the proper connection position and is shaped to be resiliently deformable to displace the connection preventing portion from the connection preventing position to a connection allowing position where the arrival of the first housing at the proper connection position is allowed. The connection detector includes a connection switch for resiliently deforming the connection allowance switch to displace the connection preventing portion to the connection allowing position by contacting the connection allowance switch with the connection detector mounted in the first housing.

DETAILED DESCRIPTION

FIGS. 1 to 18 show an electrical connection device according to a first embodiment of the invention. This electrical connection device includes a first connector C1, a second connector C2 and a connection detector 30. The first connector C1 includes first terminals T1 and a first housing 10 for holding the first terminals T1. The second connector C2 includes second terminals T2 and a second housing 20 for holding the plurality of second terminals T2. The first terminals T1 are female terminals, while the second terminals T2 are male terminals that are respectively connectable to the first terminals T1 along a common terminal connecting direction to be electrically conductive with each other by this connection. The connection detector 30 is mounted into the first housing 10 to detect a connected state of the first terminals T1 and the second terminals T2.

Figure 5:
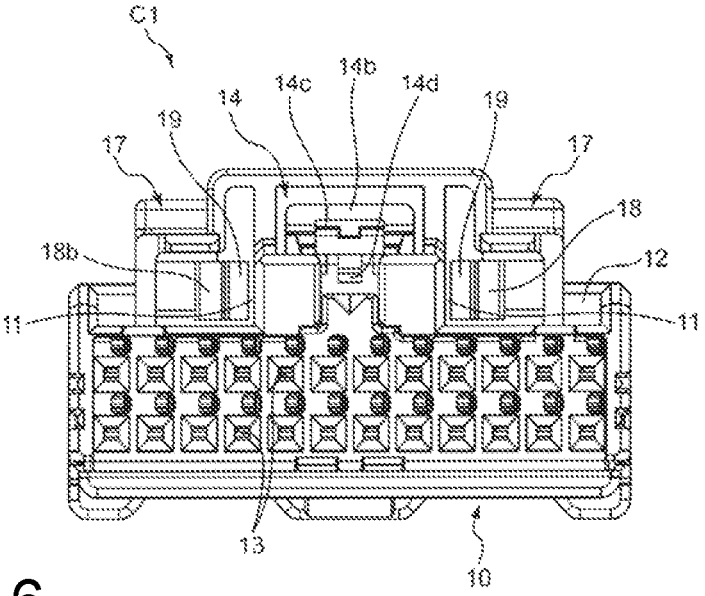
FIG. 5 is a front view of the first housing.
Figure 6:
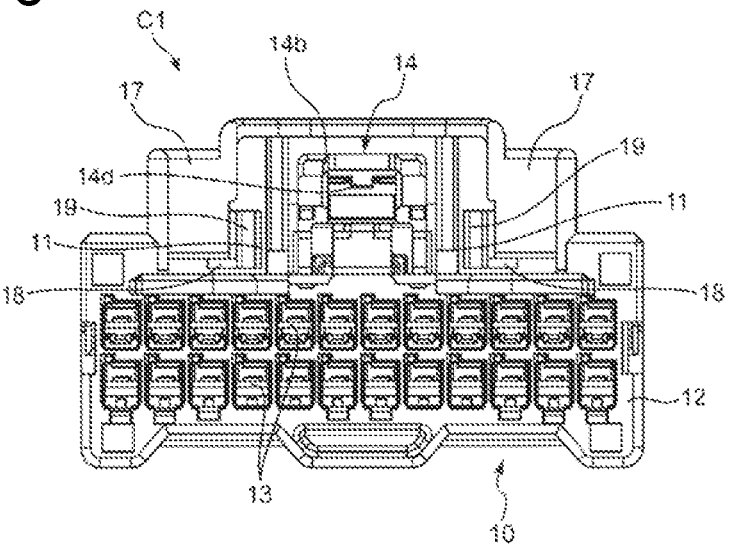
FIG. 6 is a back view of the first housing.
Figure 7:
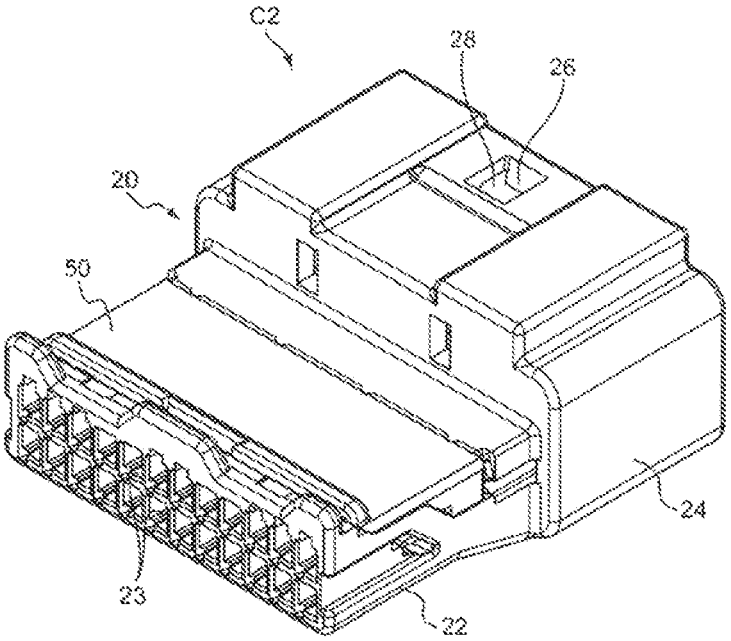
FIG. 7 is a perspective view of the second housing.

As shown in FIGS. 5 and 6, the first housing 10 includes a housing body 12 and a lock 14.

The housing body 12 is shaped to be inserted into the second housing 20 along the terminal connecting direction and has a substantially rectangular parallelepiped shape in the first embodiment. The housing body 12 includes terminal accommodation chambers 13 for respectively receiving the first terminals T1 and terminal locking portions, e.g. locking lances, for respectively locking the first terminals T1 received into the respective terminal accommodation chambers 13.

The lock 14 is locked to the second housing 20 to lock a state where the housing body 12 is inserted inside the second housing 20. Specifically, the lock 14 includes a front part 14*a*, a rear part 14*b* opposite the front part 14*a* and a locked portion 14*c* between the front and rear parts 14*a*, 14*b*. The front part 14*a* is connected integrally to the upper surface of a front part of the housing body 12. The rear part 14*b* is deflectable and deformable in a direction toward the housing body 12 (down in FIGS. 1 to 3) with the front part 14*a* as a support. A through hole 15 penetrates through the lock 14 in a thickness direction of the lock 14, i.e. in a direction of deflection and deformation at a position between the rear part 14*b* and the locked portion 14*c*, i.e. at a position on a rear side in an inserting direction of the first housing 10 into the second housing 20 (terminal connecting direction).

The rear end part 14*b* of the lock 14 functions as a detector restraining portion for restraining the connection detector 30. Specifically, the rear end part 14*b* includes a restricting engaging portion 14*d* for restraining the connection detector 30. The restraining engaging portion 14*d* is a projection formed at a rearmost position of the rear end part 14*b* and projects farther inward (down in a posture of FIG. 1) than the lower surface of a part before the restraining engaging portion 14*d*. The restraining engaging portion 14*d* is shaped to lock the connection detector 30 to prevent the separation of the connection detector 30 from the first housing 10.

The first connector C1 according to the first embodiment further includes a retainer 40. The retainer 40 collectively secondarily locks the first terminals T1 respectively accommodated in the terminal accommodation chambers 13 by being mounted into an appropriate part of the first housing 10. The retainer 40 is not essential and can be omitted as appropriate.

The second housing 20 is shaped to enclose an insertion space for receiving the housing body 12 of the first housing 10 inserted along a housing inserting direction. The housing inserting direction matches a front-rear direction (direction parallel to the terminal connecting direction) of the first housing 10. The insertion space is shaped to have an insertion opening that is open in one direction and receives the housing body 12 inserted through the insertion opening.

The second housing 20 integrally includes a terminal holding portion 22 and a peripheral wall 24.

The terminal holding portion 22 includes terminal accommodation chambers 23 for respectively accommodating the second terminals T2 and locking lances for respectively locking the second terminals T2 accommodated in the terminal accommodation chambers 23.

The peripheral wall 24 is a rectangular tube enclosing the insertion space. A back end part of the peripheral wall 24 is connected integrally to the terminal holding portion 22, while a front end part forms an insertion entrance of the first housing 10.

A part (upper central part in a posture shown in FIGS. 1 and 2) of the opening end part constitutes a locked portion 26. A through hole 25 penetrates through the peripheral wall 24 immediately behind the locking portion 26, and is shaped to receive the locked portion 14*c* of the lock 14 fit from inside. The locking portion 26 presses the locked portion 14*c* of the lock 14 from outside (upper side in FIG. 2) as the first housing 10 is inserted into the insertion space of the second housing 20, thereby resiliently displacing the lock 14 inward (down in FIG. 2). Further, when the insertion is completed, i.e. when the first housing 10 reaches a proper connection position where the first terminals T1 and the second terminals T2 are connected completely, as shown in FIG. 3, the locking portion 26 locks the locked portion 14*c* fit into the through hole 25 to restrain the locked portion 14*c* from behind (right side in FIG. 3). In this way, the locking portion 26 prevents a rearward movement of the first housing 10 and locks an inserted state of the first housing 10.

The second connector C2 according to the first embodiment further includes a retainer 50. The retainer 50 collectively secondarily locks the second terminals T2 in the respective terminal accommodation chambers 23 by being mounted into an appropriate part of the terminal holding portion 22 of the first housing 20. The retainer 50 is not essential in the present invention and can be omitted.

The connection detector 30 is mounted in the first housing 10 of the first connector C1 in advance before the connection of the first and second connectors C1, C2. Specifically, the connection detector 30 is held in the first housing 10 so as to be separable from the first housing 10 only in a state where the connection of the first and second connectors C1, C2 is completed, i.e. a state where the first housing 10 has reached the proper connection position.

More specifically, a groove 16 for holding the connection detector 30 is provided in an area on the upper surface of the housing body 12 of the first housing 10 covered by the lock 14. The groove 16 is a recessed part of the upper surface and linearly extends in a direction parallel to the housing inserting direction (terminal connecting direction) while having a constant width.

The connection detector 30 integrally includes a mounted portion 32, a gripped portion 33 and a restrained piece 34.

The mounted portion 32 is shaped to be mountable on the housing body 12 by being inserted into the groove 16 along a longitudinal direction (housing inserting direction in this embodiment) of the groove 16. Specifically, the mounted portion 32 is shaped to extend along the housing inserting direction while having a constant width. A direction in which the mounted portion 32 is inserted along the groove 16 is a front-rear direction of the connection detector 30. The gripped portion 33 is to be gripped by a worker and extends farther rearward from the mounted portion 32 along the detector front-rear direction.

The restrained piece 34 can be restrained by the lock piece 14 of the first housing 10, and integrally includes a restrained piece body 35 and a restrained engaging portion 36.

The restrained piece body 35 includes a rear part 35*a* integrally connected to the rear end of the mounted portion 32 and a front part 35*b* on an opposite end. The restrained piece body 35 has a natural shape so that the front part 35*b* is spaced from the mounted portion 32 (spaced up in FIG. 1). The natural shape is the shape of the restrained piece body 35 when the restrained piece body 35 is in a natural state without receiving any external force. Further, the restrained piece body 35 is shaped to be resiliently deflectable and deformable to allow a displacement of the front part 35*b* in a pressing direction, i.e. a direction toward the mounted portion 32 by the front part 35*b* being pressed toward the mounted portion 32 (downward in FIGS. 2 and 3) by the restraining engaging portion 14*d* of the lock 14 of the first housing 10. That is, the restrained piece body 35 is cantilevered forward to the front part 35*b* that is deflectable and deformable with the rear part 35*a* as a support.

Figure 1:
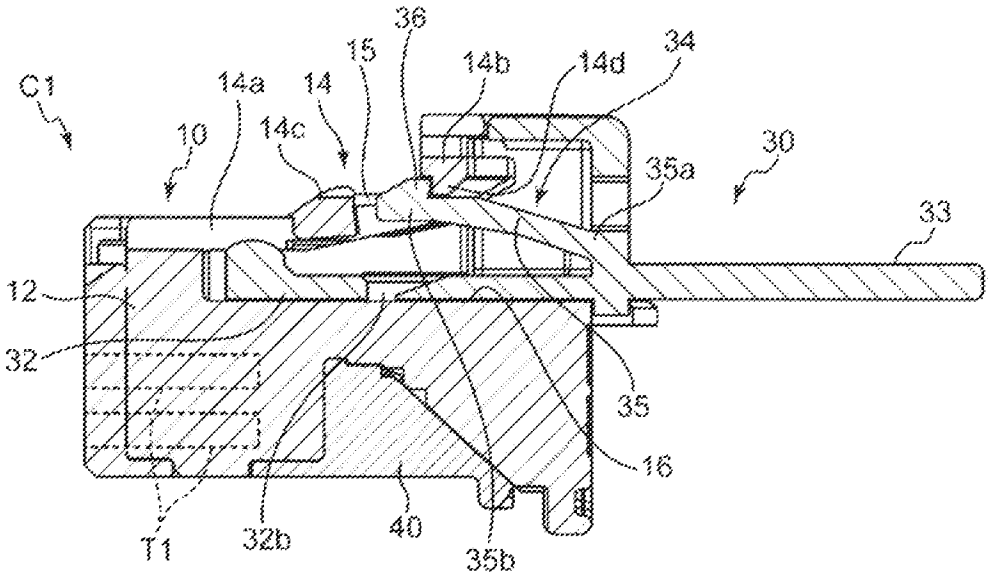
FIG. 1 is a side view in section showing a first housing of a first connector and a connection detector to be mounted into the first housing before the first housing is inserted into a second housing of a second connector in an electrical connection device according to a first embodiment of the invention.
Figure 2:
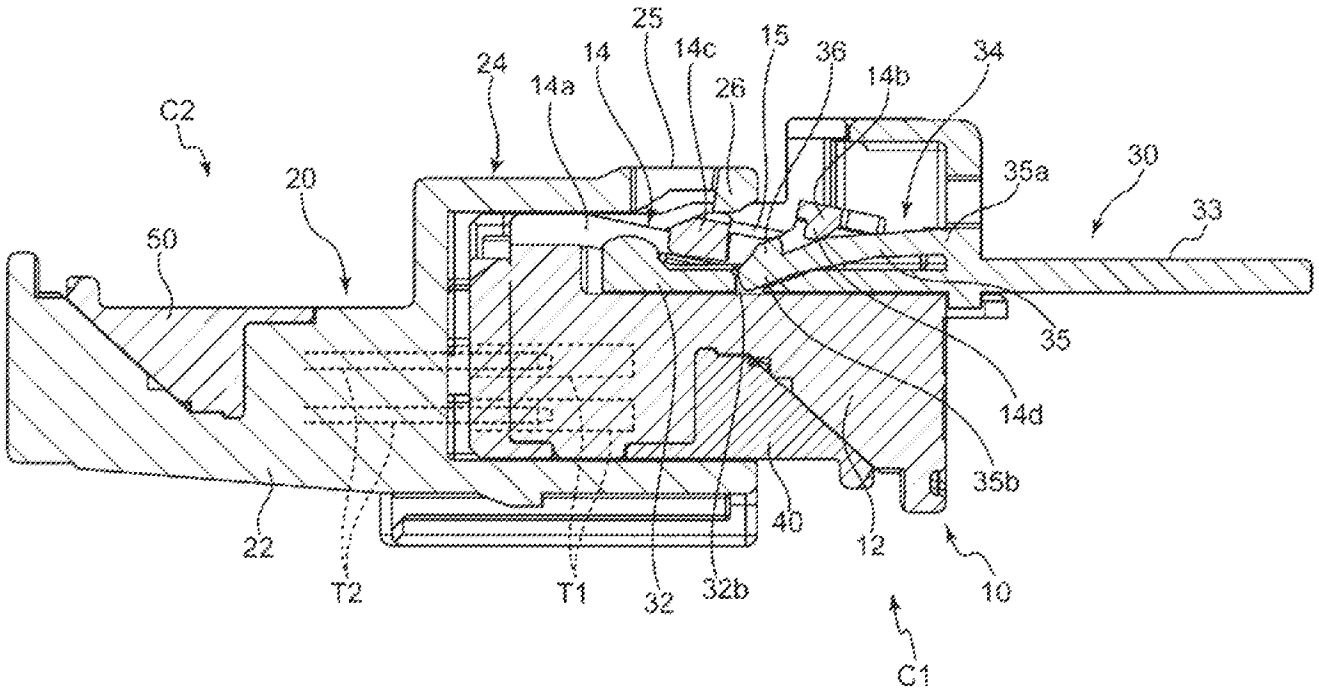
FIG. 2 is a side view in section showing an incompletely connected state where the first housing and the connection detector mounted in the first housing are inserted in the second housing and before the first housing reaches a proper connection position in the electrical connection device.
Figure 3:
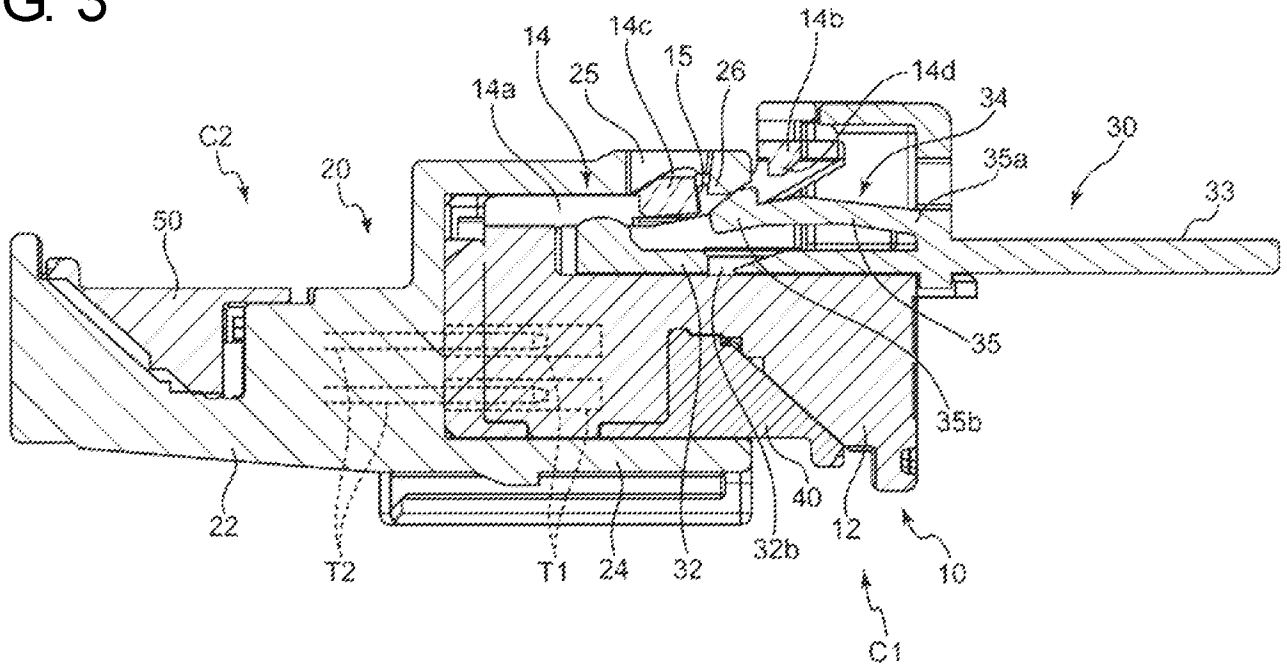
FIG. 3 is a side view in section showing a completely connected state where the first housing and the connection detector mounted in the first housing are inserted in the second housing and the first housing has reached the proper connection position in the electrical connection device.
Figure 4:
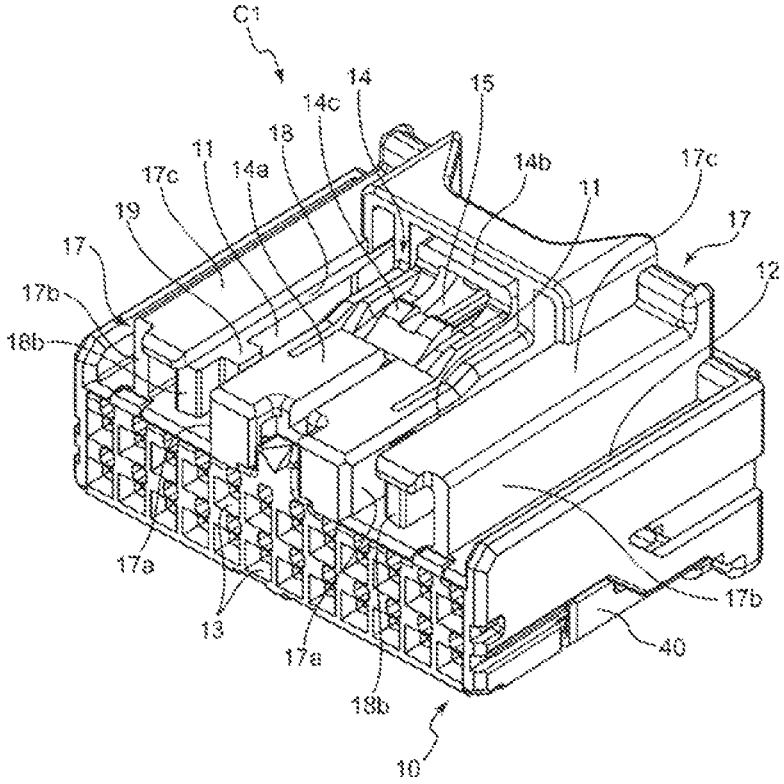
FIG. 4 is a perspective view of the first housing.

The restrained engaging portion 36 is a projection projecting farther out (direction opposite to the direction toward the mounted portion 32, up in FIGS. 1 to 3) from the front end part 35*b* of the restrained piece body 35. The restrained engaging portion 36 is located at an engaging position, as shown in FIG. 1 in the natural state where the restrained piece body 35 is not resiliently deformed, and can be displaced inward (down in FIGS. 2 and 3) as the restrained piece 35 is deformed resiliently.

The engaging position is a position where both engaging portions 36, 14*d* are engageable with each other with the restraining engaging portion 14*d* located behind the restrained engaging portion 36, as shown in FIG. 1. By this engagement, the restraining engaging portion 14*d* can prevent a rearward displacement of the restrained engaging portion 36, i.e. prevent rearward separation of the connection detector 30 from the first housing 10.

The restrained engaging portion 36 can be displaced to a retracted position, as shown in FIG. 3, and a position where the restrained engaging portion 36 comes closer to the mounted portion 32 than at the retracted position, as shown in FIG. 2, by the resilient deformation of the restrained piece body 35. The retracted position is where the restrained engaging portion 36 is separated from the restraining engaging portion 14*d* to be disengaged from the restraining engaging portion 14*d*. By this disengagement, the connection detector 30 is released and allowed to separate rearward from the first housing 10.

The mounted portion 32 is formed with a through hole 32*b* for avoiding interference with the front part 35*b* of the restrained piece body 35. The front part 35*b* can be displaced to a position where the restrained piece body 35 is fit into the through hole 32*b*, as shown in FIG. 2, by being pressed in by the restraining engaging portion 14*d* of the lock piece 14 and is deflected and displaced inward in the process of inserting the first housing 10 into the second housing 20. Also in this state, the connection detector 30 is restrained by the restraining engaging portion 14*d* to prevent rearward separation from the first housing 10.

The locking portion 26 of the second housing 20 also functions as an unlocking portion according to the present invention. Specifically, the locking portion 26 maintains the restraint of the restrained piece 34 by the lock 14 in the inserting process, as shown in FIG. 2, i.e. in the process of bringing the first housing 10 to the proper connection position where the connection of the first terminals T1 and the second terminals T2 is completed. Additionally, the locking portion 26 displaces the restrained engaging portion 36 to the retracted position and operates the restrained piece 34 to release the restraint of the connection detector 30 by the lock piece 14 when the first housing 10 reaches the proper connection position, as shown in FIG. 3.

Specifically, the locking portion 26 deflects and deforms the lock piece 14 deeply inwardly (down in FIG. 2) by pressing the locked portion 14*c* of the lock 14 from outside (upper side in FIG. 2) in the inserting process of the first housing 10, as shown in FIG. 2. Thus, the restraining engaging portion 14*d* on the rear part 14*b* of the lock 14 presses the restrained piece body 35 of the restrained piece 34 in the same direction to deeply displace the front part 35*b* to a position where the front part 35*b* of the restrained piece body 35 is fit into the through hole 32*b* of the mounted portion 32. Specifically, the lock 14 is deflected resiliently inward in the inserting process to sandwich the restrained piece 34 between the lock 14 and the housing body 12 while resiliently deforming the restrained piece 34 in a deflecting direction. In this way, firm restraint of the connection detector 30 is maintained, utilizing a spring force of the restrained piece 34.

On the other hand, with the first housing 10 located at the proper connection position, as shown in FIG. 3, the locking portion 26 is fit into the through hole 15 of the lock 14 to allow the lock 14 to return resiliently and, at the same time, is engaged with the locked portion 14*c* to prevent a rearward displacement of the locked portion 14*c*, i.e. lock the inserted state of the first housing 10 in the second housing 20 by being located behind the locked portion 14*c* of the lock piece 14 (in the housing inserting direction).

Further, the locking portion 26 displaces the restrained engaging portion 36 to the retracted position more inward than the engaging position by pressing the restrained engaging portion 36 of the restrained piece 34 from outside (upper side in FIG. 3) through the through hole 15 while being fit into the through hole 15 as described above. Thus, the restrained engaging portion 36 and the restraining engaging portion 14*d* disengage to enable the separation of the connection detector 30 from the first housing 10.

This electrical connection device further has a function of preventing the fitting of the first housing 10 into the second housing 20 in a state where the connection detector 30 is not mounted in the first housing 10, i.e. a function of preventing the connection of the first and second connectors C1, C2 (connection of the first and second terminals T1 and T2) without using the connection detector 30. More particularly, the second housing 20 includes left and right contact walls 27, shown in FIGS. 15 to 18, and the first housing 10 includes left and right receiving portions 17 respectively corresponding to the left and right contact walls 27. Connection allowance switching portions are connected to the housing body 12, and the connection detector 30 includes two connection switching portions 38.

The contact walls 27 are arranged at juxtaposed positions at a distance from each other in a lateral direction in an internal space of the peripheral wall 24. In the first embodiment, the contact walls 27 extend along the terminal connecting direction (housing inserting direction) from the front surface of the terminal holding portion 22 of the second housing 20 toward the insertion opening of the second housing 20 (toward the mating first housing 10) inside the peripheral wall 24.

Figure 8:
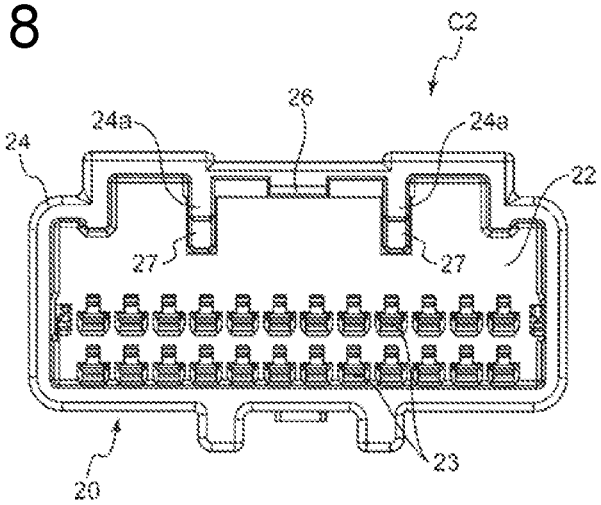
FIG. 8 is a front view of the second housing.
Figure 9:
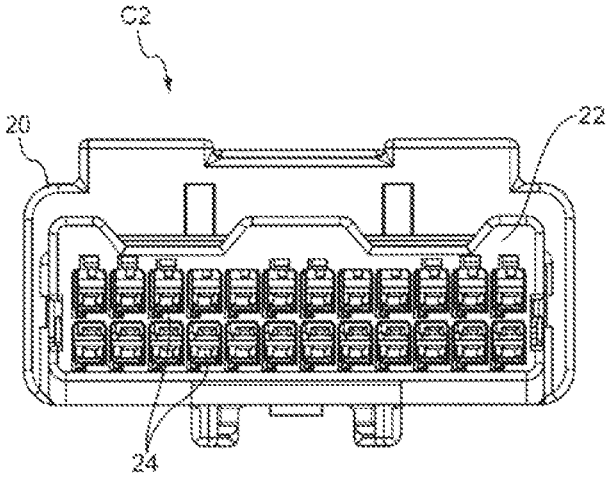
FIG. 9 is a back view of the second housing.
Figure 10:
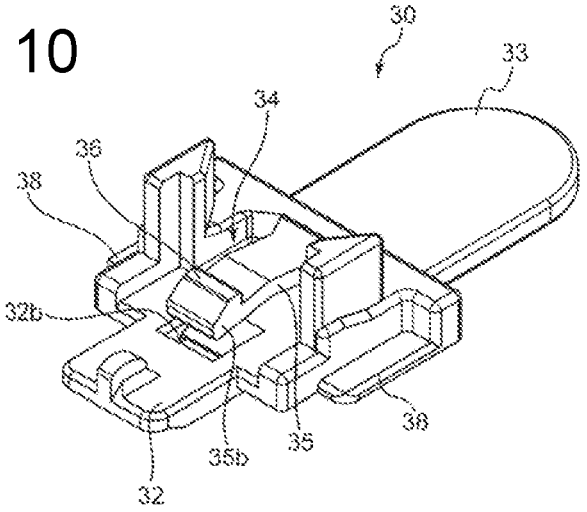
FIG. 10 is a perspective view of the connection detecting member.
Figure 11:
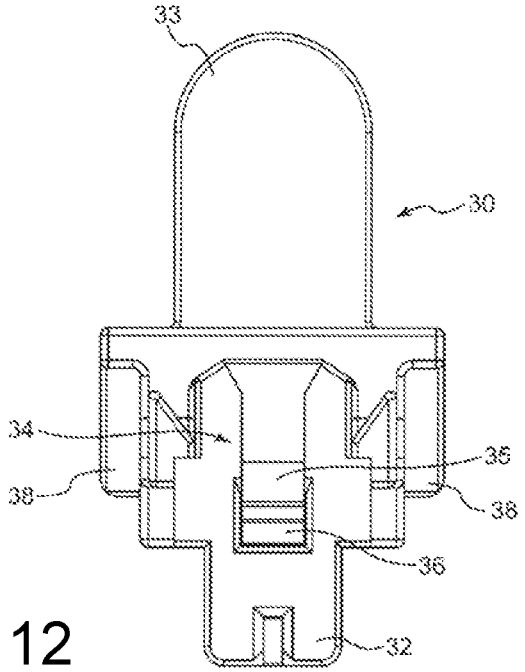
FIG. 11 is a plan view of the connection detecting member.
Figure 12:
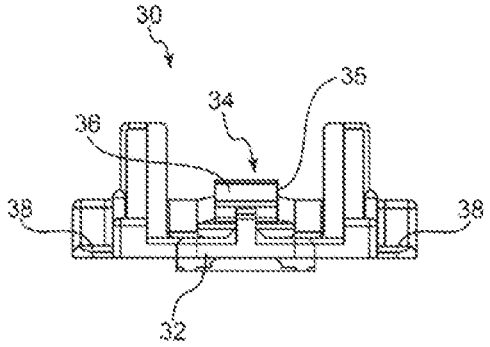
FIG. 12 is a front view of the connection detecting member.

In this embodiment, the two receiving portions 17 are spaced forward, i.e. in a direction toward the insertion opening, from the terminal holding portion 22 in the insertion space inside the peripheral wall 24 and where the receiving portions 17 function as "contact portions" and "separation preventing locking portion" according to the present invention. Specifically, as shown in FIG. 8, the peripheral wall 24 includes left and right ribs 24*a* projecting down from the lower surface of a ceiling wall of the peripheral wall 24, and the contact walls 27 project farther down from appropriate positions of the ribs 24*a*.

The receiving portions 17 are at the positions corresponding to the respective contact walls 27 in the housing body 12 of the first housing 10 and at both left and right sides of the groove 16, which is a mounting portion of the connection detector 30, located in a lateral center of the housing body 12. Additionally, the receiving portions 17 define receiving spaces 11 for receiving the contact walls 27 inserted along the terminal connecting direction (vertical direction in FIGS. 15 to 18) as the first housing 10 is inserted into the second housing 20. The receiving spaces 11 extend in a front-rear direction of the first housing 10 parallel to the terminal connecting direction.

The receiving portion 17 according to this embodiment includes an inner wall 17*a* defining an inner edge of the receiving space 11 in the lateral direction perpendicular to the front-rear direction, an outer wall 17*b* spaced laterally out from the inner wall 17*a* and defining an outer edge of the receiving space 11, and an upper wall 17*c* continuous with the outer wall 17*b* and defining an upper edge of the receiving space 11. The inner wall 17*a* also functions as a guiding wall for guiding the contact wall 27 in the terminal connecting direction.

The connection allowance switches include two deflection pieces 18 and connection preventing portions 19 integral with the respective deflection pieces 18.

The deflection pieces 18 are provided at positions inward of the outer walls 17*b* of the receiving portions 17 and each extends from the base part 18*a* in the front-rear direction of the first housing 10 parallel to the terminal connecting direction and each is resiliently deflectable and deformable in the lateral direction perpendicular to the front-rear direction. Each deflection piece 18 includes the base part 18*b* that is a rear end connected to the housing body 12 (outer wall 17*a* in figures), and a tip part 18*b* that is a front part opposite to the base 18*a*, and can be deflected resiliently with the base 18*a* as a support so that the tip 18*b*, as a free end part is deflected and displaced laterally outward.

Figure 13:
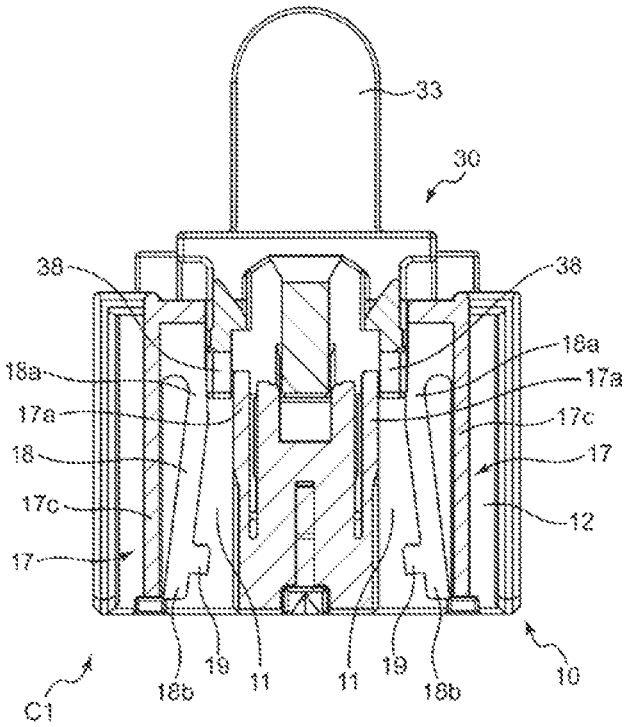
FIG. 13 is a section along XIII-XIII of FIG. 14 showing a state where the connection detector is mounted in the first housing to displace connection preventing portions to a connection allowing position.
Figure 14:
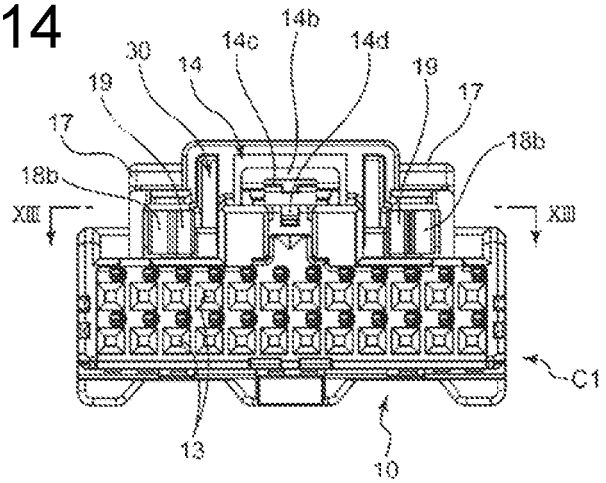
FIG. 14 is a front view showing a state where the connection detector is mounted in the first housing to displace the connection preventing portions to the connection allowing portion.
Figure 15:
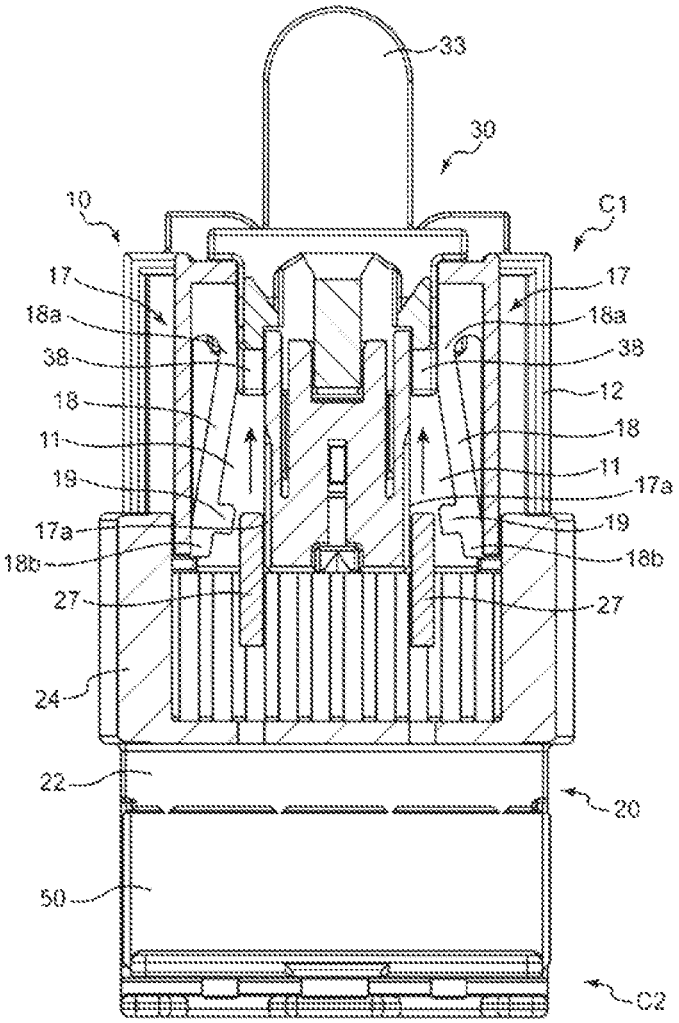
FIG. 15 is a plan view in section showing the process of inserting the first housing into the second housing with the connection detector mounted in the first housing.
Figure 16:
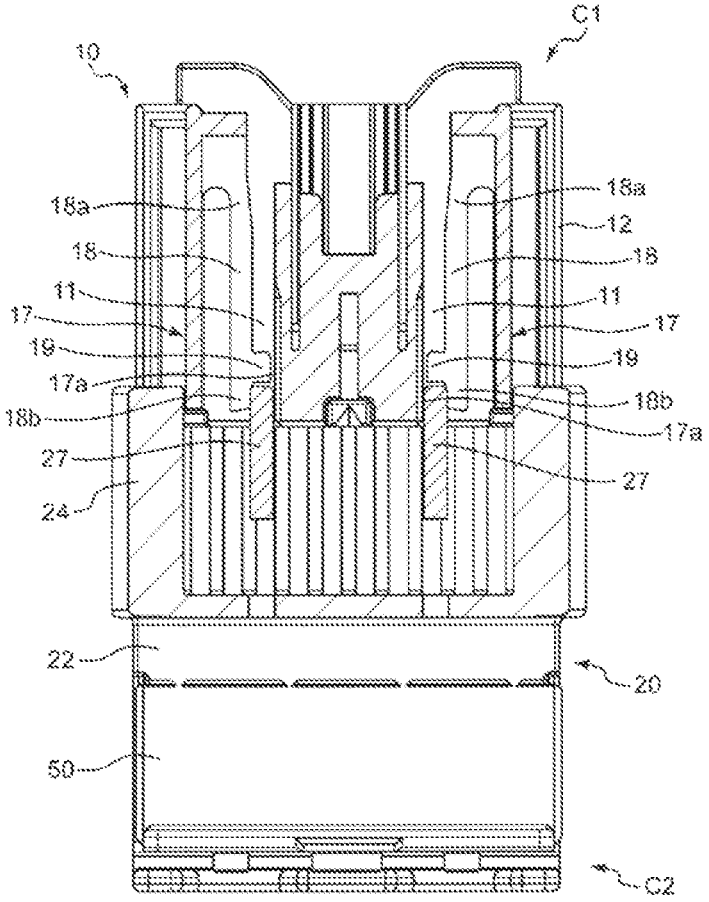
FIG. 16 is a plan view in section showing a state where the connection preventing portions at a connection preventing position prevent the insertion of the first housing into the second housing without the connection detector being mounted in the first housing.

The connection preventing portion 19 projects in from an appropriate part of the deflection piece 18, i.e. a part close to the tip 18*b* in this embodiment. The connection preventing portion 19 is held at a connection preventing position for blocking a movement path of the contact wall 27 in the receiving space 11 when the deflection piece 18 is not deformed, as shown in FIG. 16. On the other hand, the connection preventing portion 19 can be displaced to resiliently return to the connection allowing position for allowing a movement of the contact wall 27 along the receiving space 11 by being retracted laterally out from the connection preventing position, as shown in FIGS. 13 and 15, by outward deflection of the deflection piece 18.

On the other hand, the connection detector 30 includes the left and right connection switches 38. The connection switches 38 according to this embodiment are constituted by both left and right edges of the mounted portion 32.

The connection switches 38 displace the connection preventing portions 19 to the connection allowing position by contacting the connection allowance switching portions as the connection detector 30 is mounted into the first housing 10. Specifically, the two connection switches 38 press parts of the two deflection pieces 18 near the base ends 18*a* from laterally inner sides, as shown in FIG. 13, for resiliently deflecting and deforming the deflection pieces 18 laterally out as the connection detector 30 is inserted into the groove 16 interposed between the deflection pieces 18. Thus, the connection preventing portions 19 near the tips 18*b* of the respective deflection pieces 18 are displaced to resiliently return to the connection allowing position shown in FIG. 13.

In other words, the connection preventing portion 19 of each connection allowance switch is held at the connection preventing position unless the connection detector 30 is mounted, i.e. unless each deflection piece 18 is operated to be deformed resiliently.

Figure 17:
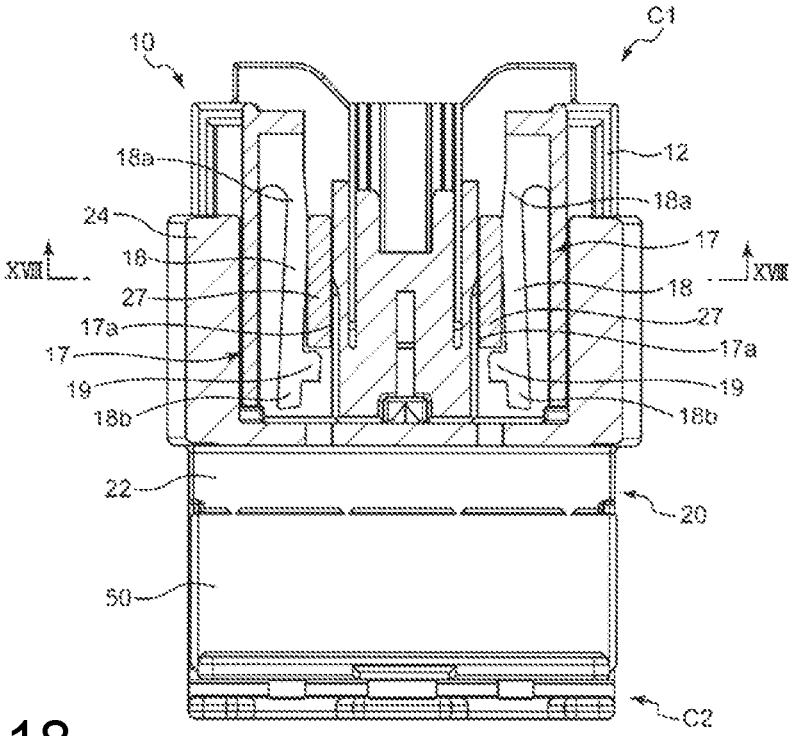
FIG. 17 is a plan view in section showing a state where the connection preventing portions returned to the connection preventing position by the separation of the connection detector from the first housing with the first housing inserted in the second housing are locked to contact walls of the second housing to prevent the separation of the first housing from the second housing.
Figure 18:
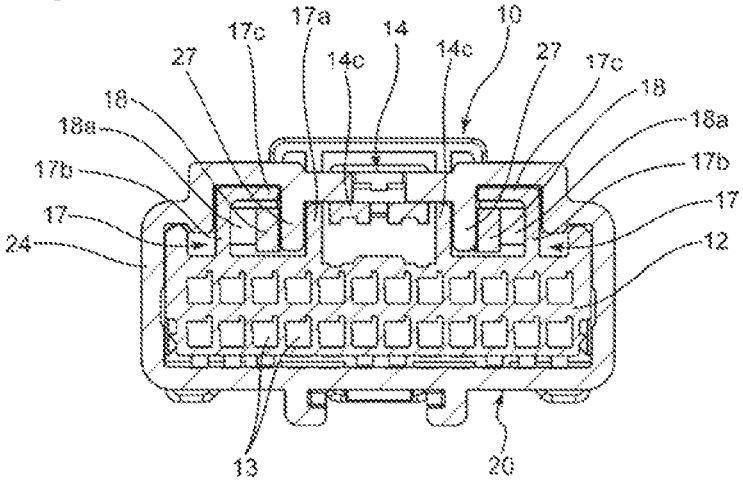
FIG. 18 is a back view in section along XVIII-XVIII of FIG. 17.
Figure 19:
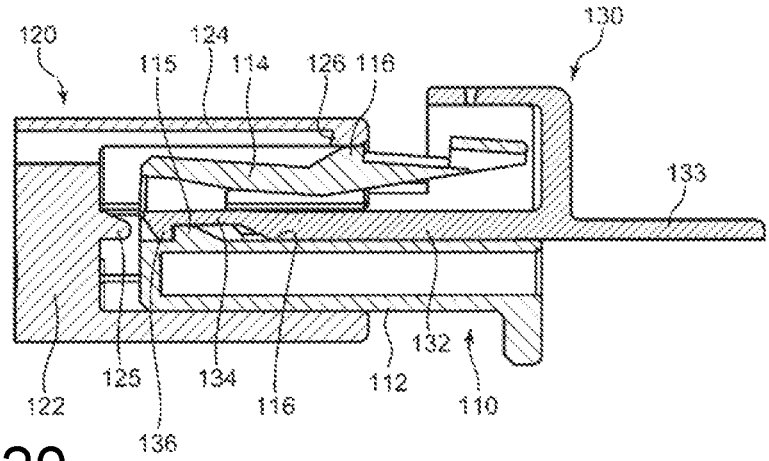
FIG. 19 is a side view in section showing the process of inserting a first housing into a second housing with a connection detector mounted in the first housing in an electrical connection device according to a second embodiment of the present invention.
Figure 20:
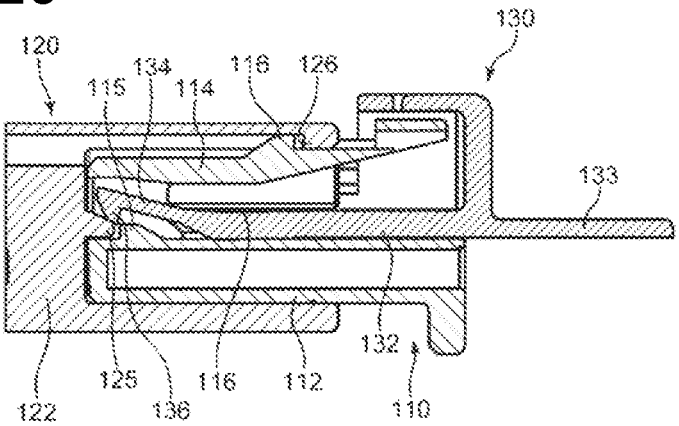
FIG. 20 is a side view in section showing a state where the first housing according to the second embodiment is completely inserted in the second housing.
Figure 21:
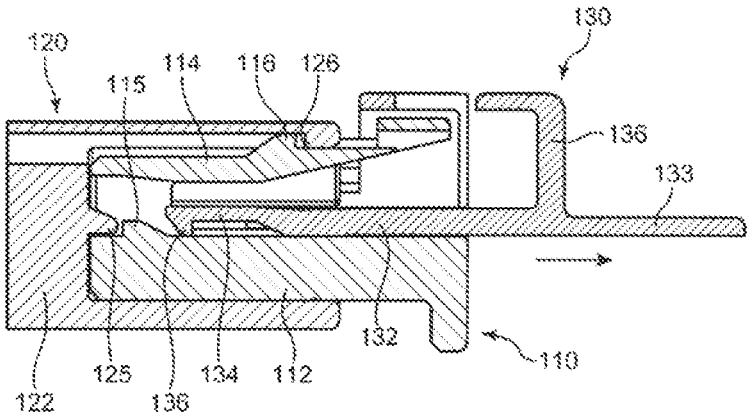
FIG. 21 is a side view in section showing the process of withdrawing the connection detector from the first housing according to the second embodiment with the first housing completely inserted in the second housing.

Further, the electrical connection device according to this embodiment has a function of preventing the separation of the first housing 10 from the second housing 20 when the connection detector 30 is separated from the first housing 10 in a completely inserted state where the first housing 10 is inserted to the proper connection position into the second housing 20. Specifically, lengths of the deflection pieces 18 and the positions of the connection preventing portions 19 on the deflection pieces 18 are set such that the respective connection preventing portions 19 displaced from the connection allowing position to the connection preventing position by the resilient return of the respective deflection pieces 18 as the connection detector 30 is withdrawn from the groove of the first housing 10 in the completely inserted state are behind the respective contact walls 27 of the second housing 20, as shown in FIGS. 17 and 18. More specifically the connection preventing portions 19 can contact the contact walls 27 (can be locked to the contact walls 27) from behind by being fit into clearances between the front surface of the terminal holding portion 22 of the second housing 20 and the contact walls 27.

Specifically, in the first embodiment, the connection preventing portions 19 prevent the separation of the first housing 10 from the second housing 20 by being locked to the contact walls 27 of the second housing 20 when the connection detector 30 is separated from the first housing 10 with the first housing 10 completely inserted in the second housing 20. The connection preventing portions 19 also prevent the insertion of the first housing 10 into the second housing 20 without the connection detector 30 being mounted in the first housing 10. Similarly, the contact walls 27 according to this embodiment prevent the connection of the first and second terminals T1, T2 by the insertion of the first housing 10 into the second housing 20 by coming into contact with the connection preventing portions 19 located at the connection preventing position. The contact walls 27 also prevent the separation of the first housing 10 from the second housing 20 by locking the connection preventing portions 19 of the first housing 10 when the connection detector 30 is separated from the first housing 10 with the first housing 10 completely inserted in the second housing 20.

The receiving portions 17 are not essential. The function described above can be obtained by combining the connection allowance switches of the first housing 10 and the connection switching portions 38 of the connection detector 30.

According to the electrical connection device described above, the connection of the first and second connectors C1, C2 and the connected state of these connectors can be confirmed, for example, in the following manner.

1) Mounting of the Connection Detecting Member 30 into the First Housing 10

Prior to the connection of the connectors C1, C2, the connection detector 30 is mounted into the first housing 10. Specifically, the mounted portion 32 of the connection detector 30 is inserted to a side inward of the lock piece 14 along the groove 16 of the housing body 12 of the first housing 10 from behind with the front end (end part opposite to the gripped portion 33: left end in FIGS. 1 to 3) of the mounted portion 32 in the lead. The restrained engaging portion 36 of the restrained piece 34 moves over the restraining engaging portion 14*d* on the rear end part 14*b* of the lock piece 14 while the restrained piece 34 is deflected and deformed. Thus, the connection detector 30 is mounted into the first housing 10, as shown in FIG. 1.

In this state, the restrained engaging portion 36 is at the engaging position as shown in FIG. 1 due to the resilient return of the restrained piece 34, and the restraining engaging portion 14*d* of the lock piece 14 is engaged with the restrained engaging portion 36, thereby restraining the connection detector 30 to prevent a displacement of the connection detector 30 to be separated rearwardly from the first housing 10.

As the connection detector 30 is mounted into the first housing 10, the connection switches 38 of the connection detector 30 respectively enter the insides of the deflection pieces 18, as shown in FIG. 13, to press the parts of the deflection pieces 18 near the base ends 18*a* out, thereby resiliently deflecting and deforming the deflection pieces 18 in the deflecting directions (lateral directions of the first housing 10 in this embodiment) to displace the connection preventing portions 19 on the tips 18*b* of the deflection pieces 18 from the connection preventing position (position shown in FIGS. 4 and 5) to the connection allowing position (position shown in FIG. 13).

2) Connecting Operation of the Connectors C1, C2

The first housing 10 having the connection detector 30 mounted therein as described above is inserted directly into the second housing 20 along the terminal connecting direction. According to this insertion, the connection of the first terminals T1 of the first connector C1 and the second terminals T2 of the second connector C2 proceeds. When the connection is completed, i.e. when the first housing 10 reaches the proper connection position, electrical conduction between the terminals T1 and T2 is established.

As described above, the mounting of the connection detector 30 into the first housing 10 is accompanied by an operation of the deflection pieces 18 by the connection switching portions 38 of the connection detector 30, i.e. an operation of retracting the connection preventing portions 19 outwardly from the connection preventing position to the connection allowing position. Thus, as the first housing 10 is inserted into the second housing 20, the contact walls 27 of the second housing 20 can move along the terminal connecting direction in the receiving spaces 11 defined in the first housing 10 without difficulty as shown in FIG. 15, thereby allowing the first housing 10 to reach the proper connection position. However, the deflection pieces 18 hold the connection preventing portions 19 at the connection preventing position if the connection detector 30 is not mounted in the first housing 10. Thus, the connection preventing portions 19 contact the contact walls 27 to prevent movements of the contact walls 27, as shown in FIG. 16, to prohibit any further insertion of the first housing 10. As just described, unless the connection detector 30 is mounted in the first housing 10, it is impossible to connect the first and second connectors C1, C2 completely. In this way, forgetting the use of the connection detector 30, i.e. proceeding with the connection of the connectors C1, C2 without using the connection detector 30 is not possible.

On the other hand, as the first housing 10 is inserted into the second housing 20, the locking portion 26 formed on the second housing 20 contacts the locked portion 14*c* of the lock 14 to press and deflect the lock 14 inwardly and to deflect the rear end part 14*b* of the lock piece 14 inward, as shown in FIG. 2. This causes the restraining engaging portion 14*d* projecting inward from the rear end part 14*b* to press the restrained piece body 35 of the restrained piece 34 of the connection detector 30 inward and displacing the front end part 35*b* of the restrained piece body 35 inward a large amount. In this way, the restraining engaging portion 14*d* sandwiches the connection detector 30 between the upper surface of the housing body 12 (bottom surface of the groove 16) and the restraining engaging portion 14*d* while resiliently deforming the restrained piece 34 to deflect the restrained piece 34 inward to maintain the restraint of the connection detector 30. Specifically, the connection detector 30 cannot be separated from the first housing 10 in an intermediate stage of the connection as in a stage before the connection. Accordingly the worker can recognize that the connectors C1, C2 are connected incompletely.

3) Arrival at the Proper Connection Position

When the first housing 10 is inserted farther to reach the proper connection position where the first and second terminals T1, T2 are connected completely, as shown in FIG. 3, the locking portion 26 is fit into the through hole 15 of the lock piece 14 to allow the resilient return of the lock piece 14. In this way, the locking portion 26 is engaged with the locked portion 14*c* of the lock 14 to lock the inserted state of the first housing 10 and, at the same time, press the restrained engaging portion 36 of the restrained piece 34 inward through the through hole 15, thereby locating the restrained engaging portion 36 at the retracted position shown in FIG. 3, i.e. a position retracted inwardly from the engaging position to be separated inwardly from the restraining engaging portion 14*d* of the lock piece 14 and released from the restraining engaging portion 14*d*. In this way, the restraint of the connection detector 30 by the lock 14 is released and, in this state, the worker can grip, for example, the gripped portion 33 of the connection detector 30 and withdraw the connection detector 30 rearward from the inside of the lock 14. Based on this, it can be confirmed that the connectors C1, C2 has been completed.

The connection detector 30 thus withdrawn can be used repeatedly for connection detection of the same electrical connection device or other electrical connection devices having an equivalent structure. Alternatively, the connected state of each first connector C1 can be managed in a centralized manner by collecting the connection detector 30 equipped in each first connector C1. For example, if plural first connectors C1 are installed at positions spaced from each other, it can be recognized that any one of the first connectors C1 is not completely connected to the second connector C2 yet if a total number of the collected connection detectors 30 is less than that of the first connectors C1.

Further, in the first embodiment, the withdrawal of the connection detector 30 from the first housing 10 is accompanied by the release of the pressing of the deflection pieces 18 by the connection switching portions 38 of the connection detector 30 thus far and the resilient return of the deflection pieces 18 caused by this release. The resilient return of the deflection pieces 18 is accompanied by the return of the connection preventing portions 19 from the connection allowing position to the connection preventing position, and this return brings the connection preventing portions 19 to a locked position, as shown in FIGS. 17 and 18, i.e. a position where the connection preventing portions 19 slip behind (below in FIG. 17) the contact walls 27 to be locked into contact with the contact walls 27 from behind. This locking prevents the separation of the first housing 10 from the second housing 20 and is released only when the connection detector 30 is mounted into the first housing 10 again. That is, the separation of the first housing 10 from the second housing 20 is allowed only by the return of the connection preventing portions 19 to the connection allowing position (separation allowing position) by the remounting of the connection detector 30 into the first housing 10. This reliably guarantees that the connection detector 30 is mounted in the first housing 10 during the next connecting operation.

Specific configurations of the connection detector and a restraint releasing portion according to the present invention are not limited. The connection detecting member only has to be mountable into the first housing and prevented from separating from the first housing during the connection of the first and second terminals and can be modified as appropriate within such a range. Further, the restraint releasing portion may operate not the lock piece 14, but the connection detector.

An example of that is shown as a second embodiment in FIGS. 19 to 22.

Similarly to the first embodiment, an electrical connection device according to the second embodiment includes a first housing 110, a second housing 120 and a connection detector 130, the first housing 110 includes a housing body 112 and a lock piece 114, the second housing 12 includes a terminal holding portion 122 and a peripheral wall 124, and the connection detector 130 includes a mounted portion 132 to be mounted and inserted into a groove 116 of the housing body 112, a gripped portion 133 and a deflectable and deformable restrained piece 134.

However, unlike the first embodiment, the restrained piece 134 according to the second embodiment is shaped to extend forward from the front end of the mounted portion 132 and be deflectable and deformable up and includes a restrained engaging portion 136 to be locked not to the lock piece 114, but to the housing body 112. Specifically, the restrained engaging portion 136 projects down on the front end of the restrained piece 134, and a restraining engaging portion 115 to be engaged with the restrained engaging portion 136 projects up on a bottom surface of the groove 116 of the housing body 112. Further, the second housing 120 includes a restraint releasing portion 125 projecting from the terminal holding portion 122 toward the first housing 110 inside the peripheral wall 124, and the restraint releasing portion 125 operates the restrained engaging portion 136 of the connection detector 130 to displace the restrained engaging portion 136 to a retracted position located above an engaging position where the restrained engaging portion 136 is engaged with the restraining engaging portion 115 and disengage the engaging portions 136, 115 while the restrained piece 134 is deflected and deformed up when the first housing 110 is inserted to a proper connection position shown in FIGS. 20 and 21 inside the peripheral wall 124 of the second housing 120.

Also in this electrical connection device, the engagement of the restrained engaging portion 136 and the restraining engaging portion 115 prevents the separation of the connection detector 130 from the first housing 110 until the first housing 110 reaches the proper connection position with respect to the second housing 120, and the restraint releasing portion 125 of the second housing 120 operates the restrained engaging portion 136 to disengage the engaging portions 136, 115 (i.e. enables the separation of the connection detector 130 from the first housing 110) when the first housing 110 reaches the proper connection position. Thus, a user can precisely recognize a connected state based on whether or not the connection detector 130 can be separated from the first housing 110.

Figure 22:
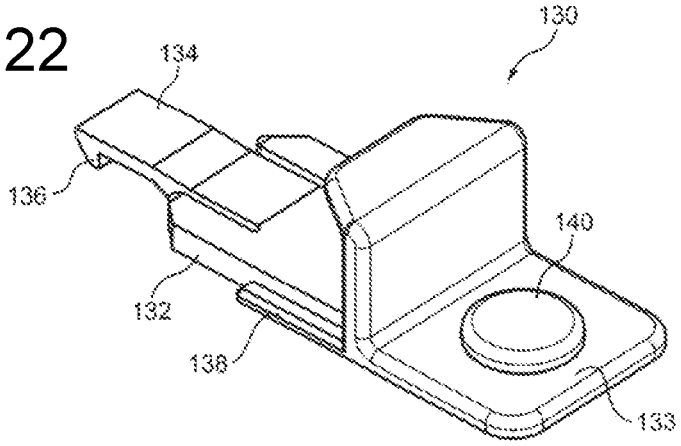
FIG. 22 is a perspective view of the connection detector according to the second embodiment.

Also in this electrical connection device, the first housing 110 is provided with connection allowance switches similar to those according to the first embodiment and the connection detector 130 is provided with connection switches for operating the connection allowance switches as the connection detector 130 is mounted into the first housing 110, e.g. connection switches 138 as shown in FIG. 22. Thus, the connection of the connectors is prevented without the connection detector 130 being mounted in the first housing 110.

Further, if the connection detector 130 includes, for example, an identification information holding portion 140, as shown in FIG. 22, it is also possible to grasp completely connected connectors out of plural connectors scattered at positions, i.e. collectively manage connector connection by collecting the connection detectors 130 and reading identification information from the identification information holding portions 140.

Besides, the present invention can include the following embodiments.

The displacing direction of the connection preventing portion according to the present invention is not limited. For example, the connection preventing portion may allow the first and second housings to approach each other by being retracted from the connection preventing position in a direction parallel to the terminal connecting direction. However, in this case, a large stroke is necessary between the connection preventing position and the connection allowing position, whereas the connection preventing portion configured to displace in the direction intersecting the terminal connecting direction from the connection preventing position as in the first embodiment has an advantage that the connection preventing portion can be retracted from the connection preventing position to the connection allowing position by a small displacement amount.

Means for displacing the connection preventing portion by the connection allowance switch according to the present invention is not limited to the deflection and deformation of the deflection piece. For example, the connection allowance switch according to the invention may include a spring for biasing the connection preventing portion in a direction from the connection allowing position to the connection preventing position, and the connection switch may displace the connection preventing portion from the connection preventing position to the connection allowing position against a spring force of the spring while resiliently deforming the spring.

If the connection allowance switc according to the present invention includes a deflection piece, the number of the deflection pieces does not matter. The connection allowance switch may include, for example, a single deflection piece. However, if the connection detector 30 is mounted into the first housing 10 to be inserted between the deflection pieces 18 as in the first embodiment, it is advantageous in suppressing a collapse of the posture of the connection detector 30 by spring forces of the deflection pieces 18 since the connection detector 30 can receive the spring forces in a well-balanced manner from opposite outer sides.

In the present invention, specific shapes and use applications of the first and second terminals do not matter. For example, the second terminal may be a joint terminal to be connected to a plurality of first terminals via shorting coupling portions to short the plurality of first terminals to each other.

As described above an electrical connection device includes a first connector and a second connector connectable to each other and in which a connected state of the first and second connectors can be detected more reliably.

Provided is an electrical connection device with a first connector including a first terminal and a first housing for holding the first terminal, a second connector including a second terminal to be electrically conductive with the first terminal by being connected to the first terminal in a specific terminal connecting direction and a second housing for holding the second terminal, and a connection detector to be mounted into the first housing to detect a connected state of the first and second terminals. The first housing includes a detector restraining portion for restraining the connection detector to prevent the separation of the connection detector from the first housing. The second housing includes a restraint releasing portion for maintaining the restraint of the connection detector by the detector restraining portion until a relative position of the first housing with respect to the second housing reaches a proper connection position where the first and second terminals are connected completely and operating at least one of the detector restraining portion and the connection detector to release the restraint of the connection detector by the detector restraining portion when the relative position reaches the proper connection position. The first housing includes a housing body and a connection allowance switching portion connected to the housing body and having a connection preventing portion. The connection allowance switching portion is shaped to hold the connection preventing portion at a connection preventing position where the connection preventing portion contacts the second housing to prevent an arrival of the first housing at the proper connection position and shaped to be resiliently deformable to displace the connection preventing portion from the connection preventing position to a connection allowing position where the arrival of the first housing at the proper connection position is allowed. The connection detector includes a connection switch for resiliently deforming the connection allowance switching portion to displace the connection preventing portion to the connection allowing position by contacting the connection allowance switch with the connection detector mounted in the first housing.

According to this electrical connection device, with the connection detector mounted in the first housing and the connection preventing portion of the connection allowance switch displaced to the connection allowing position, the first housing can be moved with respect to the second housing to proceed with the connection of the first and second terminals and the connected state of the first and second connectors can be detected using this connection detector.

Specifically, in an incompletely connected state before the first housing reaches the proper connection position, i.e. a position where the connection of the first and second terminals is completed, the detector restraining portion of the first housing restrains the connection detector to prevent the separation of the connection detector from the first housing. Thus, by noticing that the connection detector cannot be separated, an operator can recognize that the first and second terminals are in an incompletely connected state. On the other hand, when the first housing reaches the proper connection position, the restraint releasing portion of the second housing operates at least one of the detector restraining portion and the connection detector to release the restraint of the connection detector by the detecting member restraining portion and allow the separation of the connection detector from the first housing. Thus, by noticing that the separation of the connection detector is possible, the operator can recognize that the connection of the first and second terminals has been completed.

In addition, unless the connection switch of the connection detector displaces the connection preventing portion from the connection preventing position to the connection allowing position by operating the connection allowance switch. In other words, unless the connection detector is mounted into the first housing, the connection preventing portion of the connection allowance switch of the first housing is held at the connection preventing position and in contact with the second housing. Thus, a relative movement of the first housing to the proper connection position with respect to the second housing is prevented, and the connection of the first and second terminals cannot be completed. This reliably prevents the first and second connectors from being further connected without the connection detector being mounted into the first housing, in other words, without using the connection detector.

The connection allowance switching portion may include at least one deflection piece that is resiliently deformable to be deflected in a deflecting direction intersecting the terminal connecting direction, and the connection preventing portion is provided on the at least one deflection piece to be displaced from the connection preventing position to the connection allowing position by the deflection of the at least one deflection piece. In this case, the connection detector is mounted and inserted into the first housing in a direction perpendicular to the deflecting direction, and the connection switch is shaped to press the deflection piece in the deflecting direction as the connection detector is inserted into the first housing.

The at least one deflection piece may include two deflection pieces arranged at a distance from each other in the deflecting direction. One of the connection preventing portions is provided on each of the deflection pieces. The deflection pieces are arranged to be deflected in directions away from each other. The connection detector is mounted into the first housing to be inserted between the deflection pieces and displaces the connection preventing portions provided on the deflection pieces from the connection preventing position to the connection allowing position by pressing and deflecting the deflection pieces out according to the insertion.

In this arrangement, since the connection detector inserted between the deflection pieces receive spring forces of the deflection pieces from opposite outer sides, the spring forces acting on the connection detector are well-balanced. Therefore, a collapse of the posture of the connection detector by the spring forces is suppressed.

Preferably, as a structure for more reliably bringing the connection preventing portion and the second housing into contact, the second housing includes a contact portion, the first housing includes a receiving portion defining a receiving space for receiving the contact portion inserted along the terminal connecting direction, and the connection preventing portion is arranged such that the connection preventing position of the connection preventing portion is a position where further insertion of the contact portion into the receiving space is prevented and the connection allowing position of the connection preventing portion is a position retracted in a direction intersecting the terminal connecting direction from the receiving space to allow further insertion of the contact portion. This structure enables the connection preventing portion to be reliably brought into contact with the contact portion in a movement path of the contact portion in the second housing when the connection preventing portion is located at the connection preventing position.

The electrical connection device preferably has a function of allowing the separation of the first housing from the second housing only when the connection detecting member is mounted into the first housing with the first housing located at the proper connection position with respect to the second housing, in other words, a function of preventing the separation of the first housing from the second housing with the connection detector separated from the first housing. This function enables more reliable guarantee of a state where the connection detector is mounted in the first housing separated from the second housing.

Specifically, preferably, the second housing includes a separation preventing locking portion, the connection allowance switch further includes a separation preventing locked portion to be locked to the separation preventing locking portion to prevent the separation of the first housing from the second housing, and the connection allowance switch is shaped to be resiliently deformed to displace the separation preventing locked portion from a locked position where the separation preventing locked portion is locked to the separation preventing locking portion to a separation allowing position where the separation preventing locked portion is separated from the separation preventing locking portion to allow the separation of the first housing from the second housing by being operated by the connection switch of the connection detector mounted into the first housing and hold the separation preventing locked portion at the locked position without the connection detecting member being mounted in the first housing.

The connection preventing portion can double as the separation preventing locked portion, utilizing a displacement between the connection preventing position and the connection allowing position. Specifically, the connection preventing position and the connection allowing position of the connection preventing portion are set such that the connection preventing portion is separated from the separation preventing locking portion by being displaced from the connection preventing position to the connection allowing position and locked to the separation preventing locking portion by returning toward the connection preventing position from the connection allowing position. Thus, the connection preventing portion can be separated from the separation preventing locking portion by being displaced to the connection allowing position by the operation of the connection switch of the connection detector with the connection detector detected in the first housing. On the other hand, the connection preventing portion can prevent the separation of the first housing from the second housing by returning to the connection preventing position and being locked to the separation preventing locking portion by the separation of the connection detecting member from the first housing with the first and second connectors connected to each other.

In the present invention, the specific configuration of the connection detecting member is not limited. For example, the connection detector includes a restrained piece to be restrained by the first housing, the restrained piece includes a restrained engaging portion and is shaped to be resiliently deflectable and deformable to displace the restrained engaging portion from an engaging portion to a retracted position, the first housing includes a detector restraining portion for restraining the connection detector, the detector restraining portion includes a restraining engaging portion to be engaged with the restrained engaging portion to prevent the separation of the connection detector from the first housing with the connection detector mounted in the first housing and the restrained engaging portion located at the engaging position and allows the separation of the connection detector from the first housing by releasing the restrained engaging portion as the restrained engaging portion is displaced from the engaging position to the retracted position, and the second housing includes an unlocking portion for operating the restrained piece to maintain the restraint of the restrained piece by the detector restraining portion until the first housing reaches a proper connection position where the connection of the first and second terminals is completed and to displace the restrained engaging portion to the retracted position to release the restraint of the connection detector by the detector restraining portion when the first housing reaches the proper connection position.

According to this electrical connection device, when the first housing reaches the proper connection position, i.e. a position where the connection of the first and second terminals is completed with the connection detector mounted in the first housing, the unlocking portion of the second housing operates the restrained piece of the connection detector to displace the restrained engaging portion from the engaging position to the retracted position, thereby releasing the restraint of the restrained piece by the detector restraining portion of the first housing to enable the separation of the connection detector from the first housing. On the other hand, since the restraint of the restrained piece by the detector restraining portion is maintained in an incompletely connected state before the first housing reaches the proper connection position, the operator can recognize that the first and second terminals are connected insufficiently by noticing that the separation is not possible.

The invention claimed is:

1. An electrical connection device, comprising:

a first connector including a first terminal and a first housing for holding the first terminal;

a second connector including a second terminal to be electrically conductive with the first terminal by being connected to the first terminal in a specific terminal connecting direction and a second housing for holding the second terminal; and a connection detector to be mounted into the first housing to detect a connected state of the first and second terminals, wherein:

the first housing includes a detector restraining portion for restraining the connection detector to prevent the separation of the connection detector from the first housing;

the second housing includes a restraint releasing portion for maintaining the restraint of the connection detector by the detector restraining portion until a relative position of the first housing with respect to the second housing reaches a proper connection position where the first and second terminals are connected completely and operating at least one of the detector restraining portion and the connection detector to release the restraint of the connection detector by the detector restraining portion when the relative position reaches the proper connection position;

the first housing includes a housing body and a connection allowance switch connected to the housing body and having a connection preventing portion, the connection allowance switch is shaped to hold the connection preventing portion at a connection preventing position where the connection preventing portion contacts the second housing to prevent an arrival of the first housing at the proper connection position and shaped to be resiliently deformable to displace the connection preventing portion from the connection preventing position to a connection allowing position where the arrival of the first housing at the proper connection position is allowed; and the connection detector includes a connection switch for resiliently deforming the connection allowance switch to displace the connection preventing portion to the connection allowing position by contacting the connection allowance switch with the connection detector mounted in the first housing.

2. The electrical connection device of claim 1, wherein:

the connection allowance switch includes at least one deflection piece resiliently deformable to be deflected in a deflecting direction intersecting the terminal connecting direction, the connection preventing portion is provided on the at least one deflection piece to be displaced from the connection preventing position to the connection allowing position by the deflection of the at least one deflection piece, and the connection switch is shaped to press the deflection piece in the deflecting direction as the first housing moves in the terminal connecting direction with respect to the second housing.

3. The electrical connection device of claim 2, wherein:

the connection detector is mounted and inserted into the first housing in a direction perpendicular to the deflecting direction, and the connection switch is shaped to press the deflection piece in the deflecting direction as the connection detector is inserted into the first housing.

4. The electrical connection device of claim 3, wherein:

the at least one deflection piece includes two deflection pieces arranged at a distance from each other in the deflecting direction, the connection preventing portion is provided on each of the deflection pieces, the deflection pieces are arranged to be deflected in directions away from each other, the connection detector is mounted into the first housing to be inserted between the two deflection pieces and displaces the connection preventing portions provided on the deflection pieces from the connection preventing position to the connection allowing position by pressing and deflecting the deflection pieces outwardly according to the insertion.

5. The electrical connection device of claim 1, wherein:

the second housing includes a contact portion, the first housing includes a receiving portion defining a receiving space for receiving the contact portion inserted along the terminal connecting direction, and the connection preventing portion is arranged such that the connection preventing position of the connection preventing portion is a position where further insertion of the contact portion into the receiving space is prevented and the connection allowing position of the connection preventing portion is a position retracted in a direction intersecting the terminal connecting direction from the receiving space to allow further insertion of the contact portion.

6. The electrical connection device of claim 1, wherein:

the second housing includes a separation preventing locking portion, the connection allowance switch further includes a separation preventing locked portion to be locked to the separation preventing locking portion to prevent the separation of the first housing from the second housing, and the connection allowance switching portion is shaped to be deformed resiliently to displace the separation preventing locked portion from a locked position where the separation preventing locked portion is locked to the separation preventing locking portion to a separation allowing position where the separation preventing locked portion is separated from the separation preventing locking portion to allow the separation of the first housing from the second housing by being operated by the connection switch of the connection detector mounted into the first housing and to hold the separation preventing locked portion at the locked position without the connection detector being mounted in the first housing.

7. The electrical connection device of claim 6, wherein:

the connection preventing position and the connection allowing position of the connection preventing portion are set such that the connection preventing portion is separated from the separation preventing locking portion by being displaced from the connection preventing position to the connection allowing position, and locked to the separation preventing locking portion by returning toward the connection preventing position from the connection allowing position.

8. The electrical connection device claim 1, wherein:

the connection detector includes a restrained piece to be restrained by the first housing, the restrained piece includes a restrained engaging portion and is shaped to be resiliently deflectable and deformable to displace the restrained engaging portion from an engaging portion to a retracted position, the first housing includes a detector restraining portion for restraining the connection detector, the detector restraining portion includes a restraining engaging portion to be engaged with the restrained engaging portion to prevent the separation of the connection detector from the first housing with the connection detector mounted in the first housing and the restrained engaging portion located at the engaging position and allows the separation of the connection detector from the first housing by releasing the restrained engaging portion as the restrained engaging portion is displaced from the engaging position to the retracted position, and the second housing includes an unlocking portion for operating the restrained piece to maintain the restraint of the restrained piece by the detector restraining portion until the first housing reaches a proper connection position where the connection of the first and second terminals is completed and displace the restrained engaging portion to the retracted position to release the restraint of the connection detector by the detector restraining portion when the first housing reaches the proper connection position.

* * * * *